US007788904B2

(12) United States Patent
Odendall

(10) Patent No.: US 7,788,904 B2
(45) Date of Patent: Sep. 7, 2010

(54) EXHAUST SYSTEM FOR AN INTERNAL COMBUSTION ENGINE

(75) Inventor: Bodo Odendall, Buxheim (DE)

(73) Assignee: Audi AG, Ingolstadt (DE)

( * ) Notice: Subject to any disclaimer, the term of this patent is extended or adjusted under 35 U.S.C. 154(b) by 1104 days.

(21) Appl. No.: 10/583,737

(22) PCT Filed: Nov. 12, 2004

(86) PCT No.: PCT/EP2004/012843

§ 371 (c)(1),
(2), (4) Date: Jun. 20, 2006

(87) PCT Pub. No.: WO2005/064139

PCT Pub. Date: Jul. 14, 2005

(65) Prior Publication Data

US 2007/0074503 A1 Apr. 5, 2007

(30) Foreign Application Priority Data

Dec. 20, 2003 (DE) ..... 103 60 072

(51) Int. Cl.
*F01N 3/00* (2006.01)

(52) U.S. Cl. ..... 60/285; 60/274; 60/276

(58) Field of Classification Search ..... 60/274, 60/276, 277, 285, 299
See application file for complete search history.

(56) References Cited

U.S. PATENT DOCUMENTS 5,172,320 A 12/1992 Nada et al.
5,678,402 A * 10/1997 Kitagawa et al. ..... 60/276
5,842,340 A * 12/1998 Bush et al. ..... 60/274
6,119,449 A * 9/2000 Kohler ..... 60/274
6,655,129 B2 * 12/2003 Lindner et al. ..... 60/277

FOREIGN PATENT DOCUMENTS

| | | |
|---|---|---|
| DE | 100 35 238 | 1/2002 |
| EP | 1 195 507 | 4/2002 |
| EP | 1 300 571 | 4/2003 |

* cited by examiner

*Primary Examiner*—Thomas E Denion
*Assistant Examiner*—Diem Tran
(74) *Attorney, Agent, or Firm*—Novak Druce + Quigg LLP

(57) ABSTRACT

The invention relates to an exhaust system for an internal combustion engine on a vehicle, comprising an exhaust catalyst and a probe arrangement in the region of the exhaust catalyst as component of a lambda regulation device in which the engine is alternately switched between a lean and rich operating region, depending on the probe signals recorded by the probe device. According to the invention, the probe arrangement is embodied as a single, lambda probe, continuously providing probe signals, arranged downstream of the exhaust catalyst, by means of which, in cooperation with the lambda regulation device, the increase of the oxygen content in the exhaust gas flow over the whole duration of the lean operation phase and the decrease in oxygen content in the exhaust gas flow over the whole duration of the rich operation phase are each recorded in relation to an oxygen content comparison value ($U_0$), whereby in both the lean operation phase and the rich operation phase a switching threshold value ($U_1$, $U_2$; $U_{1'}$) $U_{2'}$) dependent on oxygen content is given, which, on reaching said value, the lambda regulation device is switched into the other operating region.

10 Claims, 3 Drawing Sheets

EXHAUST SYSTEM FOR AN INTERNAL COMBUSTION ENGINE

This application is a §371 of PCT/EP2004/012843, filed Nov. 12, 2004, claiming priority from DE 103 60 072.8, filed Dec. 20, 2003, each of which is hereby incorporated by reference in its entirety.

FIELD

The invention relates to an exhaust system for a an internal combustion engine on a vehicle, in particular a motor vehicle, as specified in the preamble of claim 1.

BACKGROUND

A generic, universally known exhaust system for an internal combustion system of a motor vehicle has an exhaust catalytic converter and a probe assembly in the area of the exhaust catalytic converter as a component of a lambda control device. By means of the lambda control device the internal combustion engine, as a function of the probe signals detected by the probe assembly, may be switched alternately between a lean-fuel operating range, in which the internal combustion engine is operated with a lean mixture having excess air and thus excess oxygen and a rich-fuel operating range, in which the internal combustion engine is operated with an air deficiency and thus oxygen deficiency.

Specifically, a lambda pilot probe is mounted upstream from the exhaust catalytic converter and a lambda control probe downstream from the catalytic converter. The lambda pilot probe is a so-called constant lambda probe, which is used for lambda control upstream from the catalytic converter. It is capable of detecting a relatively wide lambda signal in the range of about 0.7 to about 2. The object of using the probe is to measure deviation of the lambda generated by the engine from the assigned lambda. The lambda control probe, which is a binary lambda probe, generally can detect the passage only when lambda=1, but with very high accuracy. Such high accuracy is required for equalization to precisely lambda=1. Appropriate wiring is required for both sensors; the required structural space must also be present for both sensors.

SUMMARY

The object of the invention is to create an exhaust system for an internal combustion engine of a vehicle, a motor vehicle in particular, a system which may be produced by a simpler structural method with constant high operational reliability remaining the same. This object is attained by means of the features of various embodiments.

According to one embodiment, the probe assembly is in the form of a single lambda probe delivering a constant probe signal. The probe is mounted downstream from the exhaust catalytic converter. In conjunction with the lambda probe control device it determines over the entire length of the lean-fuel operating phase the increase in the amount of oxygen in the exhaust gas flow and over the entire length of the rich-fuel operating phase the decrease in the amount of oxygen in the exhaust gas flow in each instance in relation to a specified oxygen amount reference value. A threshold switching value dependent on the amount of oxygen is assigned in both the lean-fuel operating phase and the rich-fuel operating phase; when this value is reached, the lambda control device is switched to the respective other operating area.

It is especially advantageous that use may be made in such a configuration of a single constant lambda probe mounted downstream from the exhaust catalytic converter to regulate the operation of the internal combustion engine reliably by means of the lambda control device as a function of the oxygen balance proportional to the lambda signal, even in the absence of a control probe mounted upstream from the exhaust catalytic converter. The component cost may be advantageously reduced as a result.

In another especially preferred configuration the threshold switching value may also be determined and/or adapted as a function of an oxygen storage capacity of the exhaust catalytic converter and/or a degree of conversion of one or more pollutant components. The accuracy may be increased further by taking these values into account.

As an alternative, however, the "threshold switching value" may be in the form of gradients of increase in oxygen or decrease in oxygen of the exhaust downstream from the catalytic converter.

In addition, in certain embodiments, provision is made such that the threshold switching value is plotted in a performance graph of the engine control device.

By special preference the oxygen amount reference value specified, in certain embodiments, is in the form of the preceding threshold switching value. In principle, however, the oxygen amount reference value may also be a permanent specified value.

As a general rule, then, an exhaust system such as this as claimed for the invention provides a simple and reliable option for control of the operation of an internal combustion engine. The engine component construction cost is also lowered.

BRIEF DESCRIPTION OF THE DRAWINGS

The invention will be described below with reference to a drawing, in which.

DETAILED DESCRIPTION

Figure 1:
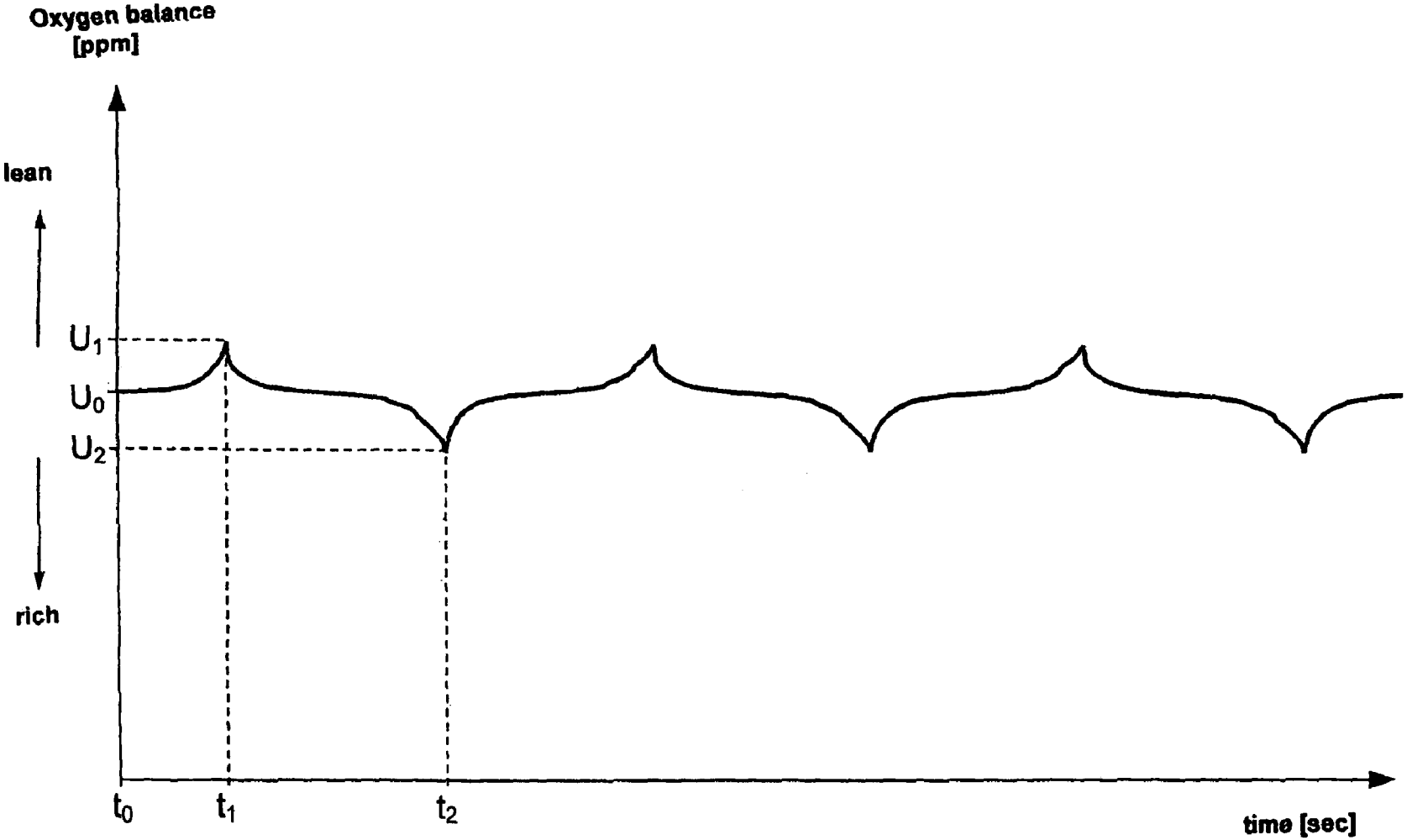
FIG. 1 presents a diagram of the variation over time of the probe signal of the permanent lambda probe mounted downstream from the exhaust catalytic converter.
Figure 2:
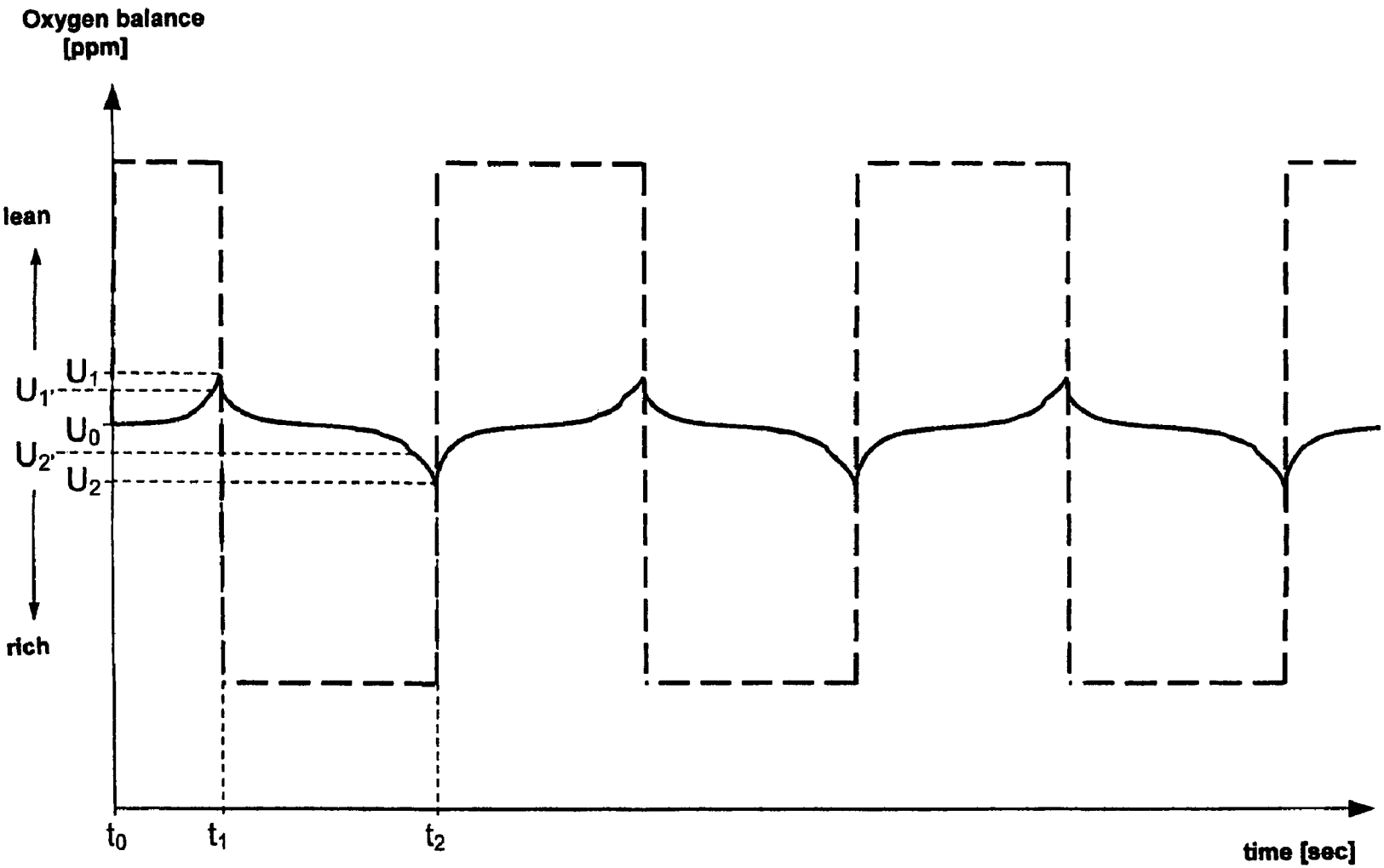
FIG. 2 presents a diagram corresponding to that of FIG. 1, one in which the pattern of variation in the oxygen balance upstream from the exhaust catalytic converter is shown by a broken line based on the measured constant lambda probe signal.

A constant probe signal measured by means of a single permanent lambda probe mounted downstream from an exhaust catalytic converter is presented as an example in FIG. 1 as a function of the oxygen balance and time. The times of switching between a lean-fuel operating range and a rich-fuel operating range as a function of the threshold switching values derived from the prescribed increase or decrease in the amount of oxygen may now be determined on the basis of this trace of the curve. For example, appropriate threshold switching values such as the threshold switching values $U_1$ and $U_2$ characterizing an upward or downward peak in the diagram may be specified in a diagram of an engine control device. The threshold switching values may, however, also be determined in the form of the gradients of increase and/or decrease in oxygen in the exhaust flow. If the increase in the amount of oxygen in the exhaust flow over the entire period of a first lean-fuel operation phase is now plotted against an initial oxygen amount reference value $U_0$ from time $t_0$ in conjunction with the curve shown in FIG. 1 by means of the single lambda probe in conjunction with the lambda control device, switching from the lean-fuel operation phase to the rich-fuel operation phase may be effected by the lambda control device when the specified switching value $U_1$ is reached. This switching is illustrated by a broken line in the diagram in FIG. 2.

Accordingly, over the entire period of the rich-fuel operating phase following the lean-fuel operating phase the lambda probe may be employed in conjunction with the lambda probe device to determine the decrease in the amount of oxygen in the exhaust flow in relation to the threshold switching value $U_1$ but also in relation to $U_0$ until the switching value $U_2$ determined as a function of the amount of oxygen reached in the rich-fuel operating phase, as a result of which switching to the lean-fuel operating range is effected again by the lambda control device. Consequently, the broken-line pattern of a signal upstream from the catalytic converter illustrated in FIG. 2 may be modeled exclusively on the basis of a constant oxygen signal measured upstream by means of a single lambda probe. In this way a probe, i.e., a so-called pilot probe, may be advantageously dispensed with upstream from the exhaust catalytic converter.

Figure 3:
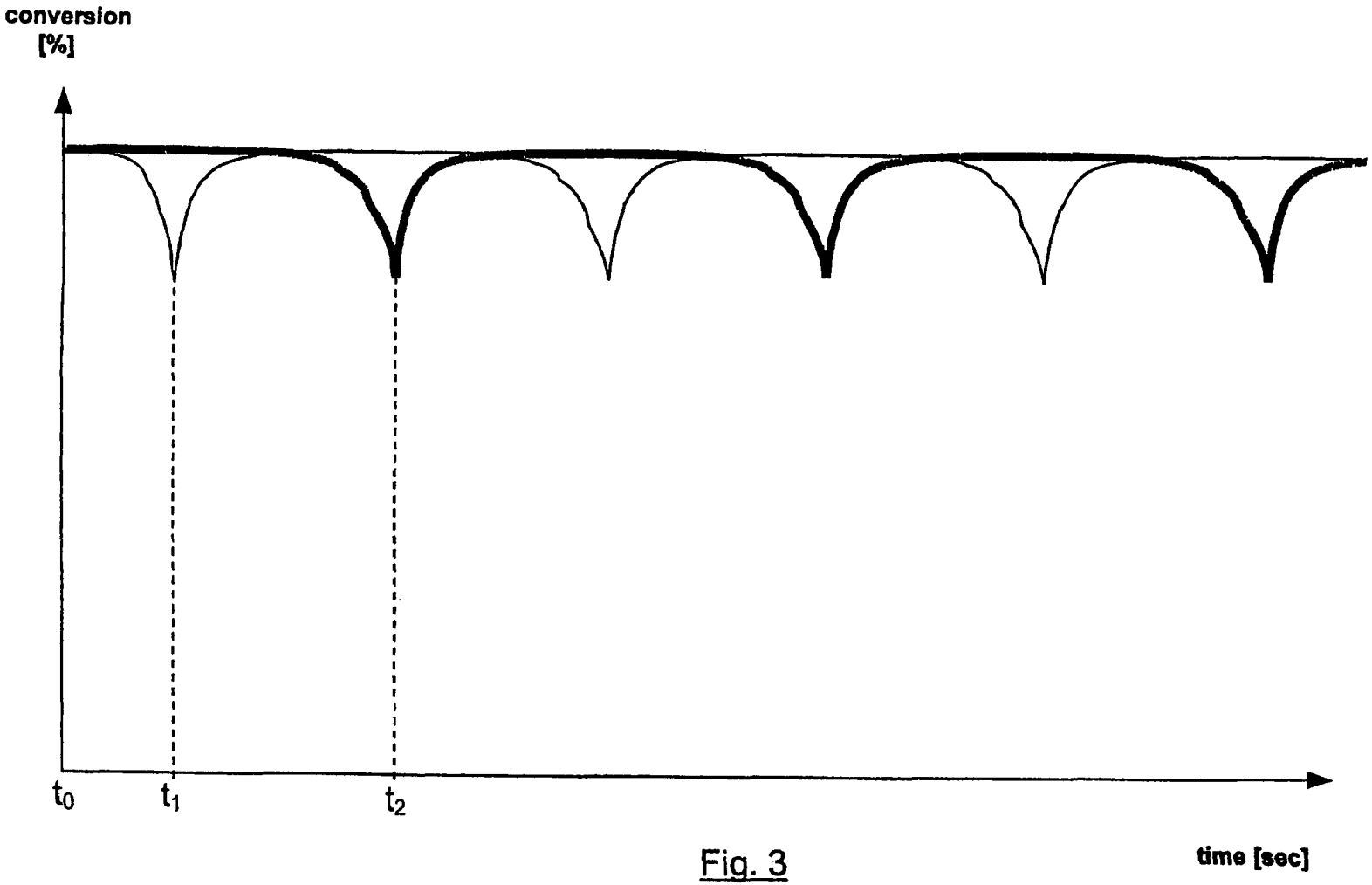
FIG. 3 presents a diagram of conversion of the pollutants CO and $NO_2$ over time in accordance with the mode of operation in FIG. 1.

The connection to conversion of $NO_2$ (thin line) and CO (bold line) is shown in FIG. 3. The conversion of $NO_2$ decreases constantly after time $t_0$ as starting point, this making it necessary to switch to rich-fuel operation at time $t_1$. This rich-fuel operation is continued up to time $t_2$ until the conversion of CO drops again. These conversion results, which may be derived from the downstream catalytic converter probe signal, may be used in evaluating and determining the threshold values for switching between the individual phases of operation, as a result of which the accuracy of the switching cycle may be substantially increased even further.

The threshold switching values $U_1$ and $U_2$ are situated here only by way of examples at the peak of the downstream catalytic converter probe signals. From the viewpoint both of time and amount of oxygen they may also occur in advance of the peak, for example, at $U_1$ and $U_2$, as is illustrated only in diagram form and by way of example in FIG. 1.

The invention claimed is:

1. An exhaust system for an internal combustion engine on a vehicle, having an exhaust catalytic converter and having a probe assembly in the area of the exhaust catalytic converter as a component of a lambda control device by means of which the internal combustion engine may be switched alternately between a lean-fuel operating range, in which the internal combustion engine is operated with a lean mixture having excess air and thus excess oxygen and a rich-fuel operating range, in which the internal combustion engine is operated with an air deficiency and thus oxygen deficiency, as a function of the probe signals detected by means of the probe assembly, wherein the probe assembly is in the form of a single lambda probe delivering a constant probe signal, such lambda probe being mounted downstream from the exhaust catalytic converter and by means of which, in conjunction with the lambda control device, the increase in the amount of oxygen in the exhaust gas flow is determined over the entire period of the lean-fuel operating phase and the decrease in the amount of oxygen in the exhaust gas flow is determined over the entire period of the rich-fuel operating phase, in relation to a specified oxygen amount reference value, an oxygen-dependent threshold switching value being specified which, when reached, causes switching of the lambda control device to the respective other area of operation.

2. The exhaust gas system as specified in claim 1, wherein the threshold switching value is at least one of determined and adapted as a function of an oxygen storage capacity and/or a degree of conversion of one or more pollutant components.

3. The exhaust gas system as specified in claim 1, wherein the threshold switching value is in the form of the gradients of increase or decrease in the oxygen of the exhaust downstream from the catalytic converter.

4. The exhaust gas system as specified in claim 1, wherein the threshold switching value is entered in a performance graph of an engine control device.

5. The exhaust gas system as specified in claim 1, wherein the oxygen amount reference value is in each instance in the form of the preceding threshold switching value.

6. A method of controlling an exhaust gas system of an internal combustion engine of a motor vehicle, said method comprising the steps of:

detecting a constant probe signal with a single lambda probe for measuring values for switching the internal combustion engine from a lean-fuel operating range to a rich-fuel operating range or from a rich-fuel operating range to a lean-fuel operating range, said lambda probe mounted downstream from the catalytic converter;

determining at least one of:

any increase in an amount of oxygen in the exhaust gas flow over the entire period of the lean-fuel operating phase, and any decrease in the amount of oxygen in the exhaust gas flow is determined over the entire period of the rich-fuel operating phase; and switching the internal combustion engine from a lean-fuel operating range to a rich-fuel operating range or from a rich-fuel operating range to a lean-fuel operating range, when, in relation to a specified oxygen amount reference value, an oxygen-dependent threshold switching value is measured by said lambda probe.

7. The exhaust gas system as specified in claim 6, wherein the threshold switching value is determined and/or adapted as a function of an oxygen storage capacity and/or a degree of conversion of one or more pollutant components.

8. The exhaust gas system as specified in claim 6, wherein the threshold switching value is in the form of the gradients of increase or decrease in the oxygen of the exhaust downstream from the catalytic converter.

9. The exhaust gas system as specified in claim 6, wherein the threshold switching value is entered in a performance graph of an engine control device.

10. The exhaust gas system as specified in claim 6, wherein the oxygen amount reference value is in each instance in the form of the preceding threshold switching value.

* * * * *